US006158063A

United States Patent [19]

Tudor

[11] Patent Number: 6,158,063

[45] Date of Patent: Dec. 12, 2000

[54] SPA COVER LIFTING DEVICE

[76] Inventor: E. Jess Tudor, 112 Henry Ct., Tracy, Calif. 95376

[21] Appl. No.: 09/299,175

[22] Filed: Apr. 23, 1999

Related U.S. Application Data

[63] Continuation-in-part of application No. 09/005,079, Jan. 9, 1998, Pat. No. 5,974,599.

[51] Int. Cl.[7] ..... E04H 4/00

[52] U.S. Cl. ..... 4/500; 4/498; 4/503; 16/280; 49/386

[58] Field of Search ..... 4/498, 500, 503, 4/496; 49/324, 380, 386, 463; 16/258, 259, 280, 281; 296/100.01, 101

[56] References Cited

U.S. PATENT DOCUMENTS 4,853,985 8/1989 Perry ..... 4/498
5,634,218 6/1997 Ouelette ..... 4/498
5,950,252 9/1999 Fettes ..... 4/498
5,974,599 11/1999 Tudor ..... 4/498

*Primary Examiner*—Charles R. Eloshway
*Assistant Examiner*—Kathleen J. Prunner
*Attorney, Agent, or Firm*—Richard Esty Peterson Patent Attorney

[57] ABSTRACT

A spa cover lifting device for lifting a folding spa cover seated on a spa from a seated position to a vertical storage position, the spa cover lifting device having a frame apparatus with a horizontal cross member and a pair of side members with ends having pivotal mounts connectable with the spa, the horizontal cross member engaging the folding spa cover at the fold and transporting the cover when folded over the cross member from the seated position to the storage position when the frame apparatus is pivoted, the spa cover lifting device including a spring mechanism that assists raising the cover and cushions descent of the cover into its folded storage position.

10 Claims, 3 Drawing Sheets

SPA COVER LIFTING DEVICE

This application is a continuation-in-part of my application Ser. No. 09/005,079 filed Jan. 9, 1998 now U.S. Pat. No. 5,974,599, issued Nov. 2, 1999, of the same title.

BACKGROUND OF THE INVENTION

This invention relates to a spa cover lifting device, and in particular, to a mechanism provided in kit form to facilitate the removal, storage and replacement of insulated spa covers of the type having a centerfold. The spa cover lifting device of this invention was designed to ease the burden of removing and replacing spa covers by equipping a water spa with a mechanism that lifts and conveniently stores the spa cover for easy removal and replacement.

The spa cover lifting device is preferably provided in kit form to allow the adjustable lifting device to be assembled and utilized with a variety of different-sized spa covers. In addition to removing and replacing the spa cover, the lifting device is constructed to conveniently support the spa cover in an elevated position adjacent the spa to extend the useful life of the spa cover and prevent its premature damage.

The spa cover lifting device includes a pivoting frame apparatus that engages the spa cover at its centerfold and transports the folded cover to a convenient location adjacent the spa on which the cover is deployed. The pivoting frame apparatus has a unique configuration to enable the pivoted cover to be positioned in a low-profile, vertical folded condition against the spa. Additionally, the unique configuration of the frame apparatus enables the frame itself to be displaced to a position that minimally interferes with the use of the spa. Furthermore, the kit form of the spa cover lifting device enables the mechanism to be easily assembled and adapted to a particular manufacturers' spa and cover configuration with minimal installation labor. In an improved embodiment, the spa cover lifting device includes a spring mechanism in a mounting bracket for the pivoting frame apparatus that both assists in lifting the spa cover to its storage position and cushions the pivotal descent of the spa cover as it reaches its storage position. These and other features of the invented spa cover lifting device will become apparent from the following summary and detailed description of the preferred embodiments.

SUMMARY OF THE INVENTION

The spa cover lifting device of this invention comprises a lifting mechanism for a folded spa cover that is commonly used to cover and insulate a heated spa.

The term "spa" is used to generally describe a hot tub or other bath facility with a whirlpool that is customarily used at home or at an apartment or condominium complex. In general, a volume of water in the spa is maintained heated for an extended period of time and it is therefore desirable to cover the spa with a cover that provides a thermal insulation for the heated water in addition to protection from debris. The lifting mechanism includes a frame apparatus that is pivotally connected to the spa or to the housing or support structure of the spa. The frame apparatus preferably has telescoping elements that permit adjustment of the frame apparatus to spa covers of different size that are sold as standard equipment or as separate accessories to a spa.

A conventional spa is typically constructed with an inner water container with external water heating and circulating systems for circulating heated water to the inner container. The inner container and circulating conduits are typically housed in a cabinet or in a support pedestal which provides an exterior surface for attachment of the lifting mechanism. Details of the internal construction of the spa are omitted in this description as being unnecessary to the structure and operation of the lifting device of this invention.

The spa cover lifting device is utilized in conjunction with a spa cover of the folding type that includes a thick, padded cover piece that is centrally folded to facilitate the removal, placement and storage of the cover. The lifting device of this invention not only assists in removal and replacement of the cover, but is designed to conveniently store the cover in a suspended position to preserve the form of the cover piece and maintain the cover in an elevated position to prevent contact with the ground, which may be damp with spilled or splashed spa water. The lifting device thereby minimizes handling of the spa cover during use of the spa, which avoids damage and greatly extends the useful life of the cover.

The spa cover of this invention utilizes a specifically configured frame that minimizes the vertical lift required to displace the spa cover to its storage position and vertically stores the spa cover in a lowered position with the frame apparatus located in an out-of-the-way position. The frame apparatus in an improved embodiment is equipped with a spring mechanism that assists in raising and lowering the spa cover and cushions the motion of the frame apparatus as it reaches its raised or lowered position. These and other advantages will become apparent upon a consideration of the detailed description as follows.

DETAILED DESCRIPTION OF THE PREFERRED EMBODIMENTS

Figure 1:
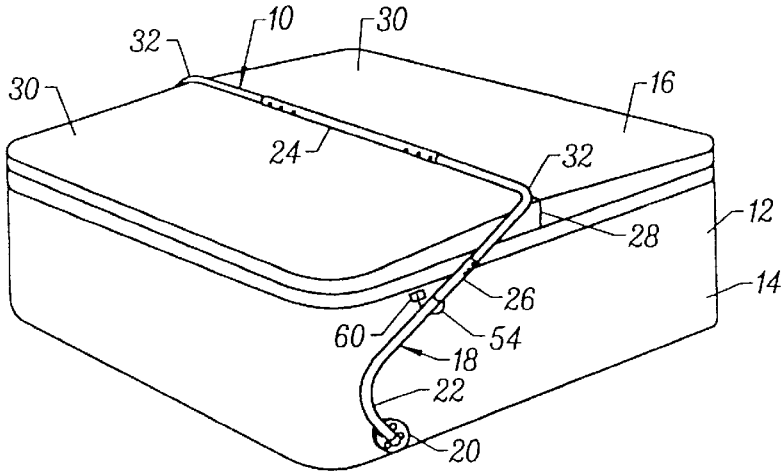
FIG. 1 is a perspective view of the spa cover lifting device installed on a spa and attached to a spa cover.

The spa cover lifting device of this invention is shown in FIG. 1 and the lifting device is designated in general by the reference numeral 10. The lifting device 10 is shown pivotally mounted to a spa 12 having a generally rectangular housing structure forming an outer cabinet 14 with a folding spa cover 16 situated on the spa.

The spa cover lifting device 10 comprises a lifting mechanism 18 with a pivotal mount 20 and a frame apparatus 22 that includes a cross member 24 and side members 26 connected to the cross member to form a U-shaped yoke with the side members positioned to depend on opposite sides of the housing structure. The folding spa cover 16 is of typical construction with a cover 16 having a central fold 28 forming two sections 30. The central fold 28 is aligned with the cross member 24 of the frame apparatus 22, enabling the spa cover to be folded over the cross member 24 for removal.

Figure 2:
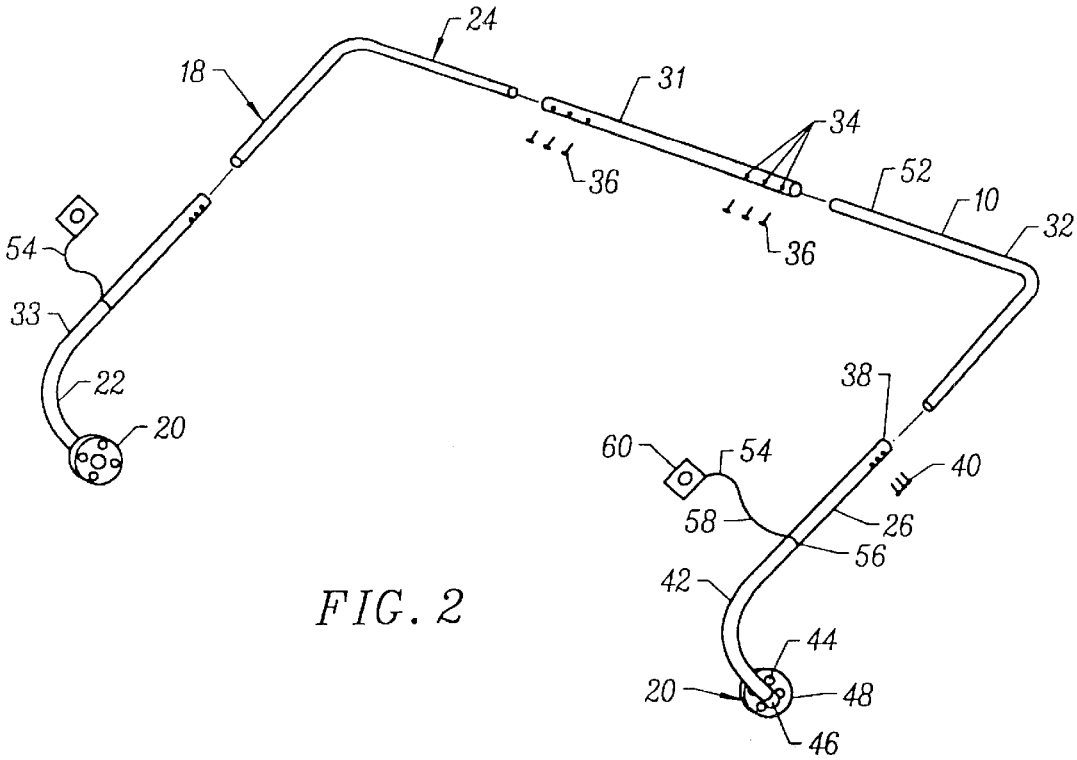
FIG. 2 is a perspective view, partially exploded of the elements of the lifting mechanism of the spa cover lifting device of FIG. 1.

The spa cover lifting mechanism 18 is shown in FIG. 2 with the component elements exploded to show the kit form of the lifting device 10. As shown in FIG. 2 the cross member 24 includes a spreader bar 31 that is connected to each of two corner elements 32 that when interconnected form part of the cross member 24 and side members 26. The corner elements 32 are slightly smaller in diameter than the spreader bar 31 and a pair of bent pivotal elements 33 that form the major part of the side members 26. This allows the corner elements 32 to insert into the ends of the spreader bar 31 and pivotal elements 33. The spreader bar 31 includes a series of spaced holes 34 to receive self tapping screws 36 that fixedly connect the spreader bar 31 to the corner elements 32 during installation and adjustment. Similarly, the pivotal elements 33 include holes 38 for a fixed connection of the pivotal elements 33 to the corner elements 32 using self threaded screws 40 during installation and adjustment. The pivotal elements 33 include a bend 42 and an end 44 that is press-fit into a nipple and elbow assembly 46. The elbow assembly 46 threadably and pivotally engages a cabinet flange 48 that is adapted to connect to a part of the spa structure. The threadable engagement of the elbow assembly 46 and the flange 48 allows the assembled lifting mechanism 18 to be pivoted about the flange 48 using the threaded interconnection as a bearing surface.

Preferably, the spreader bar 31 and pivotal elements 33 are fabricated from aluminum tube stock bent in the configuration shown with a 90 degree angle on an 8 inch radius. The corner elements 32 are preferably fabricated from tubular steel stock providing the necessary strength for the smaller diameter tube. The steel tube is galvanized steel, powder coated and bent at an angle of 87 degrees. This allows the horizontal cross member 24 that is formed by the spreader bar 31 and the horizontal segments 52 of the corner elements 32 be sized according to a particular spa cover with sufficient spread to permit connection to the elbow assemblies 46 of the pivotal mounts 20.

To limit the travel of the frame apparatus 22, the lifting mechanism 18 includes a pair of tethers 54 which are attached to the pivotal elements 33 by a loop 56 of a tether cable 58 which connects each of the pivotal elements 33 to a tether bracket 60, which is attached with the wood screws (not shown) to the cabinet 14 of the spa 12 as shown in FIG. 1. The tether 54 limits the pivot of the frame apparatus 22 during the removal of the spa cover 16 and the suspended storage of the spa cover adjacent one side of the spa 12 as shown in the sequence of FIGS. 3–5.

Figure 3:
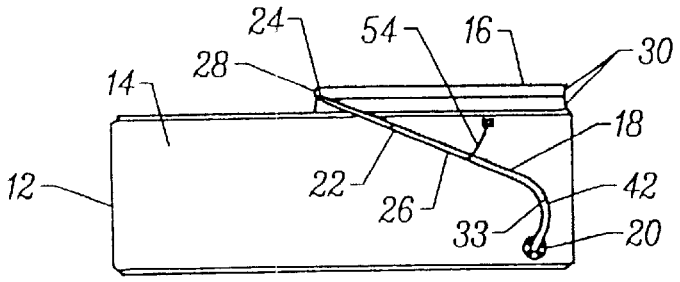
FIG. 3 is a schematic view of the spa cover lifting device in a first position.
Figure 4:
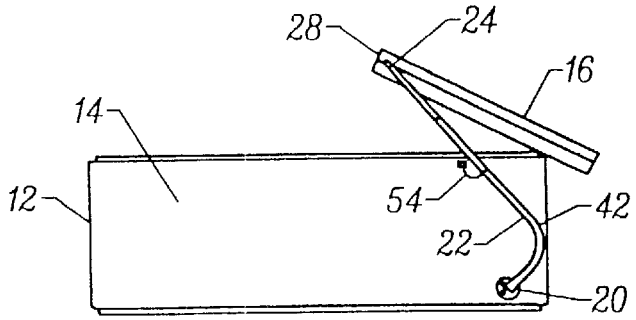
FIG. 4 is a schematic view of the spa cover lifting device in a second, intermediary position.
Figure 5:
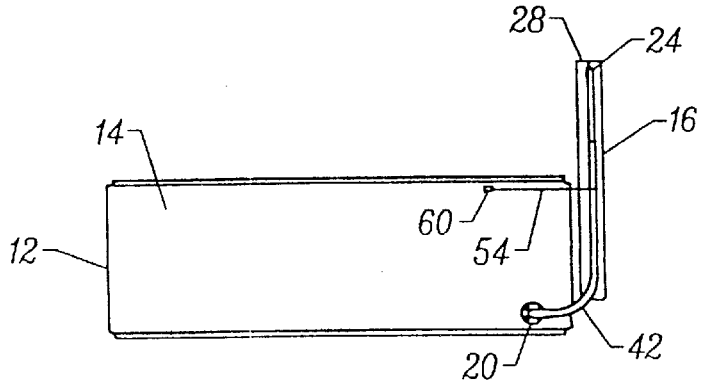
FIG. 5 is a schematic view of the spa cover lifting device in a third storage position.

Referring to FIGS. 3–5 the lifting mechanism 18 is shown mounted to the cabinet 14 of the spa 12 by the pivotal mounts 20. Side members 26 are oriented in the position in which the cross member 24 is contained within the central fold 28 of the spa cover 16, which in FIG. 3 is shown with its sections 30 folded one upon the other. In this position, the tether 54 is slack. As a user lifts the spa cover by pivoting one of the side members 26 on the pivotal mount 20, the folded spa cover 16 is lifted at the central fold 28 and displaced over the spa 12 as shown in FIG. 4, toward one end of the spa 12.

As shown in FIG. 5 when the frame apparatus 22 reaches the appropriate position to vertically suspend the folded spa cover 16 adjacent the spa 12, the tether 54 becomes taut and retains the frame apparatus 22 in the optimum position. It is to be understood that the bend 42 in the pivotal elements 33 allows the spa cover 16 to be lifted with a minimum elevation and to be conveniently located adjacent or proximate one end of the spa 12 as shown in FIG. 5. Additionally, the bent contour of the pivotal elements 33 enables the frame apparatus 22 to be conveniently positioned in an out-of-the-way position to minimize any interference with users of the facility. The "forward fulcrum" design of the side members 26 effectively increases the horizontal travel to vertical lift ratio of the spa cover 16 allowing the suspension of the cover on the cross member 24 to be lower than if a straight lever arm were used. The lowered profile of the spa cover 16 during storage minimizes injury from gusting wind or reckless play.

In assembling the lifting mechanism 18, the spreader bar 31 is positioned in the middle of the spa cover 16 at one side of the central fold 28. The corner elements 32 are installed by telescoping into the spreader bar 31 and then into the pivotal elements 33. The side members 26 are positioned on the cabinet 14 and the pivotal mount 20 is positioned and secured to the cabinet 14 using conventional wood screws. The spreader bar 31 is rotated to position the spaced holes 34 away from the fold 28 to minimize contact of the cover by the screws 36 when installed to minimize wear during the transport process. The corner elements 32 and pivotal elements 33 are secured after final adjustment. The frame apparatus 22 is positioned to the vertical position as shown in FIG. 5 to locate and secure the bracket 60 of the tether 54 so that the tether is taut when the lifting mechanism 18 is so positioned when carrying the folded spa cover. The tether brackets 60 are secured to each side of the cabinet 14 with wood screws (not shown). To lift the spa cover 16, the cover is simply folded over the cross member 24 and one of the side members 26 is manually pivoted until the tether becomes taut. The cover is automatically transported to the vertical storage position adjacent the spa.

Figure 6:
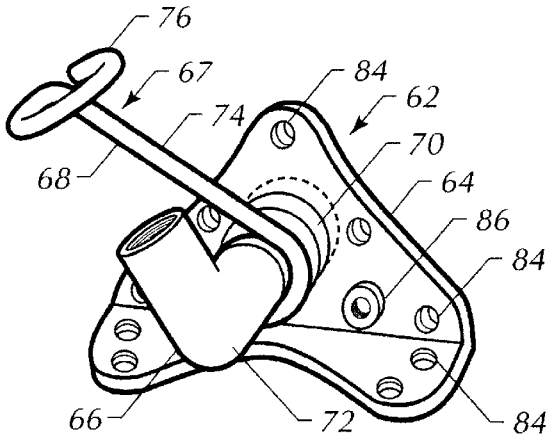
FIG. 6 is a perspective view of a double acting spring bracket for the spa cover lifting device.

Referring to FIG. 6, an improved pivotal mount 62 for mounting the frame apparatus 22 is shown. The mount 62 comprises a bracket member 64, a pivotal elbow assembly 66 and a double acting spring mechanism 67 with a torsion spring 68. The torsion spring 68 has a coil segment 70 wrapped around the axial portion 72 of the elbow assembly 66 with a torsional arm segment 74 having an end coil forming an anchor cuff 76. The anchor cuff 76 connects the spring 68 to the end segment 77 of the side members 26 as shown for one of the members 26 in FIG. 7.

Figure 7:
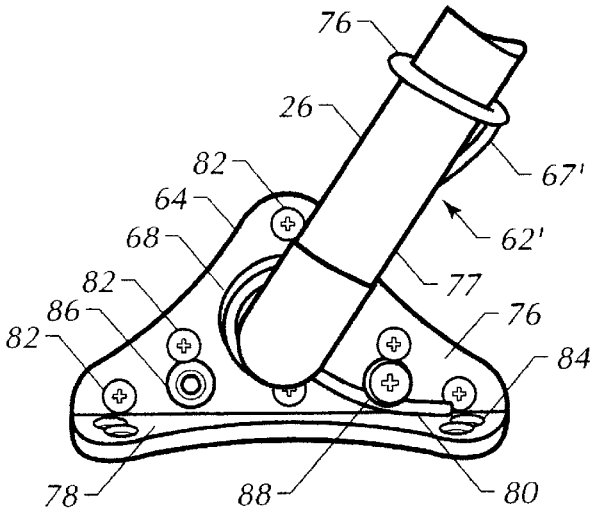
FIG. 7 is a perspective view of a double acting spring bracket installed on a spa.
Figure 8:
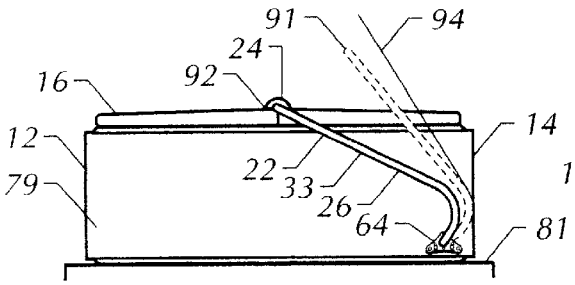
FIG. 8 is a schematic view of the spa cover lifting device with the double acting spring bracket in a first position.
Figure 9:
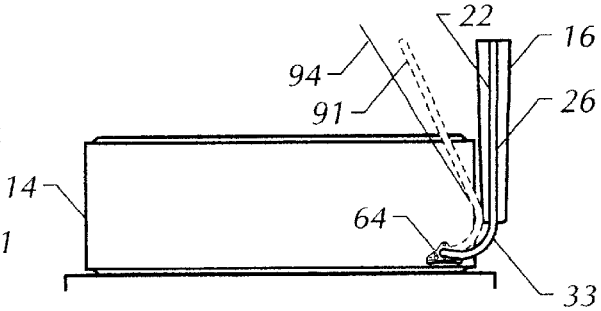
FIG. 9 is a schematic view of the spa cover lifting device with the double acting spring bracket in a second position.

Referring to FIG. 7, the pivotal mount 62' has a spring mechanism 67' as shown that is adapted for the opposite side of the spa from the mechanism 67 of FIG. 6. The bracket member 64 of the pivotal mount 62' includes a first bracket face plate 76 for mounting the bracket member 64 to a vertical structural member and a second bracket face plate 78 for mounting the bracket member 64 to a horizontal structural member on the spa 12. In FIGS. 8 and 9 the mounting bracket member 64 is mounted to the side 79 of the cabinet 14 of the spa 12 of FIG. 1. The second bracket face plate 78 is perpendicular to the first bracket face plate 76 and allows the frame apparatus 22 to be mounted to the support for the spa such as a base 81. This allows the spa cover lifting device to be used with spas having round octagonal or other non-rectangular configurations. The second bracket face plate 78 also provides a seat for the foot segment 80 of the spring 68.

The first bracket face plate 76 in FIG. 7 is shown with wood screws 82 in the mounting holes 84 to secure the pivot mount 62 to the vertical side 79 of the cabinet 14 as shown in FIGS. 8 and 9. The first bracket face plate 76 also includes a threaded anchor boss 86 on each side of the elbow assembly 66 for anchoring the foot segment 80 of the spring 68 by engaging a machine screw 88 with the foot segment 80, trapping the foot segment 80 against the face. The anchoring of the foot segment 80 enables the spring to be double acting by engaging and resisting pivot of the pivotal elements 33 in either direction. The two bosses 86 allow a single bracket casting to be used for either side of the spa when used with an appropriately configured spring 68.

The double acting spring mount 62 is designed to assist removal and replacement of the spa cover 16 and to cushion the pivotal motion of the frame apparatus 22. The spring 68 is designed to lighten, but not entirely relieve the load. In this manner, without the weight of the cover the spring 68 would begin to engage on the downward pivot of the pivotal element 33, when the arm segment 91 is approximately 45° from the horizontal, as shown in dash line in FIG. 8. With the restraining weight of the cover, for example, a cover which engages the cross member 24 with loops 92 the side member 26 is pulled down to position as shown in FIG. 8. When the spa cover 16 is folded over and one side element 26 is grasped by the spa user to raise the cover, both side elements 26 of the frame apparatus 22, readily respond and assist in lifting, giving the impression of structural integrity to the frame apparatus. In the system without the spring assist, the opposite side from the point of lift lags, providing a slight twist to the frame apparatus.

As the frame apparatus 22 with the folded spa cover 16 is pivoted, the spring 68 starts to exert a resistance, for example, at the position of the side member 26 with the arm segment 91 at approximately 30° from the vertical, as shown in dotted line in FIG. 9. The reference line 94 in FIGS. 8 and 9 is the approximate mid-point of the range where the spring 68 has no effect on the pivot. As the pivot of the side member 26 moves to the storage position shown in FIG. 9 the spring resistance increases cushioning the displacement to the storage position and incidently reducing the dynamic tensile force on the limiting tethers 54 (shown in FIGS. 3–5). The opposite effect occurs when the frame apparatus is pivoted from the storage position to the cover position.

Where a spring assist is not desired, the spring can be removed from the mount 62 and the mount 62 operates in the manner described with reference to FIGS. 1–5. When it is desired that the spring mount 62 only operate proximate the storage position, the machine screw 88 anchoring the foot segment 80 is removed. In this arrangement, the foot segment 80 pivots with the frame apparatus toward the covering position, but is restrained by contact with the second bracket face 78 when the frame apparatus 22 is pivoted toward the storage position.

When the anchor screw 88 is removed, the cross member 24 will lay flat on the spa cover 16, even without the cover loops 92.

With safety a concern, the mount 62 is constructed with a bracket member 64 having rounded corners and edges. The spring mechanism 67 is designed with the anchor cuff 76 around the end segment 77 of the side member 26 to insure that it will not dislodge with the potential for injury. The use of the improved pivotal mount expands the versatility of the spa cover lifting device and improves the ease of operability.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A spa cover lifting device for removing, storing and replacing a folding spa cover that is seated on a spa having an external structure with sides and a base the lifting device comprising:

a lifting mechanism including a frame apparatus having a horizontal cross member over which the spa cover is foldable and a pair of side members connected to the horizontal cross member wherein a U-shaped yoke is formed with the side members being positionable to depend on opposite sides of the external structure of the spa, the side members each having an end with a mount means on the end for pivotally connecting the frame apparatus to the external structure with the frame apparatus being pivotal from a first position with the spa cover situated on the spa folded over the cross member, to a second position with the spa cover folded over the cross member and vertically suspended adjacent one side of the external structure wherein;

each side member has a bend, wherein the side members are configured to enhance the ratio of horizontal displacement of the cross member relative to vertical displacement when pivoting the folded spa cover from the position seated on the spa to the second vertical storage position adjacent the spa, wherein the mount means is a pair of brackets, each bracket having a double acting spring mechanism that engages the frame apparatus and assists in displacing the frame apparatus from the first position to the second position and from the second position to the first position, and wherein the double acting spring mechanism of each bracket includes a pivotal elbow apparatus with an axis of pivot and a coil spring having a coil around the elbow apparatus and the axis of pivot with a first anchor end engaging the end of the side member and moveable with the side member and a second anchor end engageable with the bracket.

2. The spa cover lifting device of claim 1 wherein the brackets have a first face plate wherein the brackets are mountable to the sides of the external structure of the spa with the first face plate and a second face plate wherein the brackets are alternately mounted to the base of the external structure of the spa with the second face plate.

3. The spa cover lifting device of claim 1 wherein the first anchor end coil spring has a coil wrapped around the side member.

4. The spa cover lifting device of claim 3 wherein the second end of the coil spring engages the second face plate.

5. The spa cover lifting device of claim 3 including an anchor screw wherein the second end of the coil spring is anchored to the bracket with the anchor screw.

6. A spa cover lift device for a spa on a support structure, the spa having a plurality of opposite sides and a top with a foldable spa cover having a central fold supportable on the top of the spa, the spa cover lift device comprising:

first and second tubular side elements having first and second ends;

a pair of pivot brackets mountable to either one of the spa and support structure on opposite sides of the spa, one bracket of the pair being connected to the first end of one of the tubular side elements and the other bracket of the pair being connected to the first end of the other of the tubular side elements;

a tubular cross member positionable at the central fold of the spa cover, the cross member having opposite ends, one end connected to the second end of the first tubular side element and the other end connected to the second end of the second tubular side element, wherein the spa cover is foldable over the cross member when the cross member is positioned at the central fold of the spa cover and transportable to a storage position with the spa cover vertically suspended from the cross member adjacent one of the sides of the spa, wherein the tubular side elements each have a bend with a first portion of each of the side elements being substantially vertically oriented with the spa cover when the spa cover is in the storage position and a second portion that is substantially horizontal when the spa cover is in said storage position, wherein each bracket has a double acting spring mechanism and wherein the double acting spring mechanism of each bracket includes a pivotal elbow apparatus with an axis of pivot and a coil spring having a coil around the elbow apparatus and the axis of pivot with a first anchor end engaging the end of the side member and moveable with the side member and a second anchor end engageable with the bracket.

7. The spa cover lifting device of claim 6 wherein the brackets have a first face plate wherein the brackets are mountable to the sides of the external structure of the spa with the first face plate and a second face plate wherein the brackets are alternately mounted to the base of the external structure of the spa with the second face plate.

8. The spa cover lifting device of claim 7 wherein the first anchor end coil spring has a coil wrapped around the side member.

9. The spa cover lifting device of claim 8 wherein the second end of the coil spring engages the second face plate.

10. The spa cover lifting device of claim 8 including an anchor screw wherein the second end of the coil spring is anchored to the bracket with the anchor screw.

* * * * *